United States Patent [19]

Yokoyama

[11] 4,111,007

[45] Sep. 5, 1978

[54] YARN CHANGING DEVICE IN A FLAT-BED KNITTING MACHINE

[75] Inventor: Nobuaki Yokoyama, Kodaira, Japan

[73] Assignee: Silver Seiko Ltd., Kodaira, Japan

[21] Appl. No.: 851,972

[22] Filed: Nov. 16, 1977

[30] Foreign Application Priority Data

Nov. 26, 1976 [JP] Japan ..... 51-141102

[51] Int. Cl.[2] ..... D04B 3/06; D04B 15/48; D04B 27/10; D04B 35/00

[52] U.S. Cl. ..... 66/125 R; 66/60 R; 66/138; 66/127

[58] Field of Search ..... 66/127, 131, 126, 138, 66/125, 141, 60, 64; 139/453

[56] References Cited

U.S. PATENT DOCUMENTS

| | | | |
|---|---|---|---|
| 3,342,220 | 9/1967 | Bartosek et al. | 139/453 |
| 3,782,421 | 1/1974 | Budzyna | 139/453 |
| 3,911,700 | 10/1975 | Tschumperun | 66/127 |

*Primary Examiner*—Ronald Feldbaum
*Attorney, Agent, or Firm*—Lane, Aitken, Dunner & Ziems

[57] ABSTRACT

A yarn changing device for use in a flat-bed knitting machine having a carriage. The yarn changing device provides a relatively simple but effective arrangement for repetitive, alternating selection of any one of three or more yarns for knitting operation upon such successive reciprocation of the machine carriage.

14 Claims, 16 Drawing Figures

YARN CHANGING DEVICE IN A FLAT-BED KNITTING MACHINE

BACKGROUND OF THE INVENTION

This invention relates to a yarn changing device in a flat-bed knitting machine, especially a hand-operated flat-bed knitting machine, and more particularly to a yarn changing device which has three or more yarn guides selectively shiftable to and from an operative position.

A knitting machine is customarily provided with a yarn changing device to facilitate the changing of the various yarn feeds, for example, for effecting multicolor or fairisle pattern knitting with the machine. A yarn changing device for use with a flat-bed knitting machine having a carriage mounted for slidable movement on the needle bed is conventionally disposed at one end of the needle bed and has three or more yarn guides each shiftable to and from an operative position to permit the associated yarn to be fed to the knitting needles. Each time it is necessary to change the particular knitting yarn, the associated yarn guide must be selectively brought into the operative position.

The fairisle knitting pattern in which the pattern of the fabric is knitted with a yarn of a given color against the background of the fabric with a yarn of a different color is a preferred fairisle pattern to be knitted on a flat-bed type knitting machine. In knitting such patterns on a flat-bed knitting machine the two yarn guides are conventionally, alternately brought to the operative position in response to each reciprocation of the carriage on the needle bed. The respective yarns are fed to knitting needles through a yarn carrier on the carriage when the yarn guides are in the operative position.

A still more attractive, modified form of fairisle knitting pattern is one in which the pattern and the background of the fabric includes at least three different colors and in which any complete course of stitches includes another color. This modified fairisle pattern requires yarns of at least three different colors. In knitting this modified fairisle pattern certain courses of stitches are knitted with two differently colored yarns which are alternately brought into the operative positive with each reciprocation of the carriage whereas certain other courses of stitches are knitted with one or the other of those two yarns and a third yarn. Accordingly a yarn changing device, especially for a hand-operated flat-bed knitting machine, is preferably constructed to successively select two out of the several yarn guides provided and to successively bring two yarn guides thus selected, alternately into the operative position, all in synchronism with the reciprocations of the carriage.

Swiss Pat. No. 387,858 discloses a yarn changing device having a construction similar to that just described which includes four slidable yarn guides, each provided with an abutment, and each being urged from the operative position by a spring. A drive shaft adapted to be driven by the carriage to rotate about its axis by an angle of 45° is disposed transversely to the yarn guides. The drive shart has a pair of toothed wheels mounted for axial displacement thereon and for rotation integral therewith. Each wheel has four angularly equally spaced teeth for engagement with the abutments of the yarn guides and is disposed relative to the other wheel so that the teeth of a given wheel are displaced by an angle of 45° relative to the teeth of the other wheel.

Each wheel is manually displaceable along the axis of the drive shaft to permit alignment with and selection of a yarn guide. Thus, when the carriage is operated, the drive shaft is rotated as previously described and the selected yarn guide is engaged at the abutment thereof by a tooth of the wheel aligned therewith and is thereby slidably moved to the operative position against the urging of the spring. The yarn guide thus moved is held in the operative position until a subsequent rotation of the drive shaft causes the tooth of the wheel to move clear of the abutment of the yarn guide, thereby releasing the yarn guide. With this arrangement, alternate actuation is achieved for the two selected yarn guides into the operative position by the angular displacement of the teeth between the two wheels which are, in turn, equalized with the rotational angle of the drive shaft.

The yarn changing device of Swiss Pat. No. 387,858, however, is less than satisfactory in certain applications because, for example, the selection of a yarn, particularly a third yarn as described above, cannot always be performed with a simple operation of manually displacing a toothed wheel to the proper position. This difficulty exists because the movement of either toothed wheel on the shaft is dependent upon the other. For example, when a yarn guide on one side of the first selected yarn guide is to be newly selected in place of the previously selected yarn guide on the other side of the first, the toothed wheel then aligned with the first yarn guide must be displaced. Such a displacement, however, causes an undesirable release of the first yarn guide from the operative position in which it should preferably remain. Thus, it is seen that selection of a new yarn sometimes may require complicated operational steps which, in turn, may lead to errors.

A program-controlled yarn changing device apparently capable of providing various yarn changing sequences, including those just described, is disclosed in German Patent Application No. 2,357,938, laid open on May 28, 1975. That patent application discloses a yarn changing device actuatable by the carriage and including a control means using a conventional perforated program card as the program providing means and an overriding manually operable means for selecting the yarn guides independent of the program card. This device, however, is not well suited for knitting operations in which two selected yarns are alternately brought into operative position for feeding in response to the reciprocating movement of the carriage. The control means disclosed in German Patent Application No. 2,357,938 is unduly complicated for such an application and a specially prepared program card is required. Alternatively, the required yarn guides must be manually selected each time the carriage is slidably reciprocated on the needle bed. A less than satisfactory procedure.

SUMMARY OF THE INVENTION

Accordingly, a principal object of the present invention is to provide an improved yarn changing device in a flat-bed knitting machine for selecting and changing the yarns required for knitting a pattern in which two successively selected yarns are alternately brought into the operative position for feeding in response to each reciprocation of the carriage on the needle bed.

Another object of the invention is to provide an improved yarn changing device disposed to be actuated by the carriage to alternately bring two successively selected yarns into the operative position for feeding on which selection of any yarn can be performed with a simplist manual operation of the device.

Still another object of the invention is to provide a yarn changing device having a new and simplified mechanism for alternately bringing two successively selected yarn guides to the operative position upon each actuation by the carriage.

The yarn changing device according to the present invention includes at least three yarn guides, each being selectively movable between first and second inoperative positions and an operative position and being manually operable for movement between the first and the second inoperative positions; actuating means responsive to the reciprocating movement of the carriage for actuating a yarn guide in the second inoperative position for movement beyond the operative position against the urge of an associated spring; and a locking member provided for each yarn guide and adapted to hold the associated yarn guide in the operative position against the spring. When a yarn guide is moved beyond the operative position by and thereafter released from the actuating means, the associated locking member locks and holds the yarn guide in the operative position until the yarn guide is subsequently moved from the position by the actuating means whereupon another yarn guide may be moved beyond the operative position to be subsequently held by its associated locking member. Thus, the apparatus of the present invention operates to alternately bring two selected yarns into the operative position for feeding.

The invention will be better understood from the following description taken in conjunction with the accompanying drawings.

DESCRIPTION OF THE PREFERRED EMBODIMENTS

Figure 1:
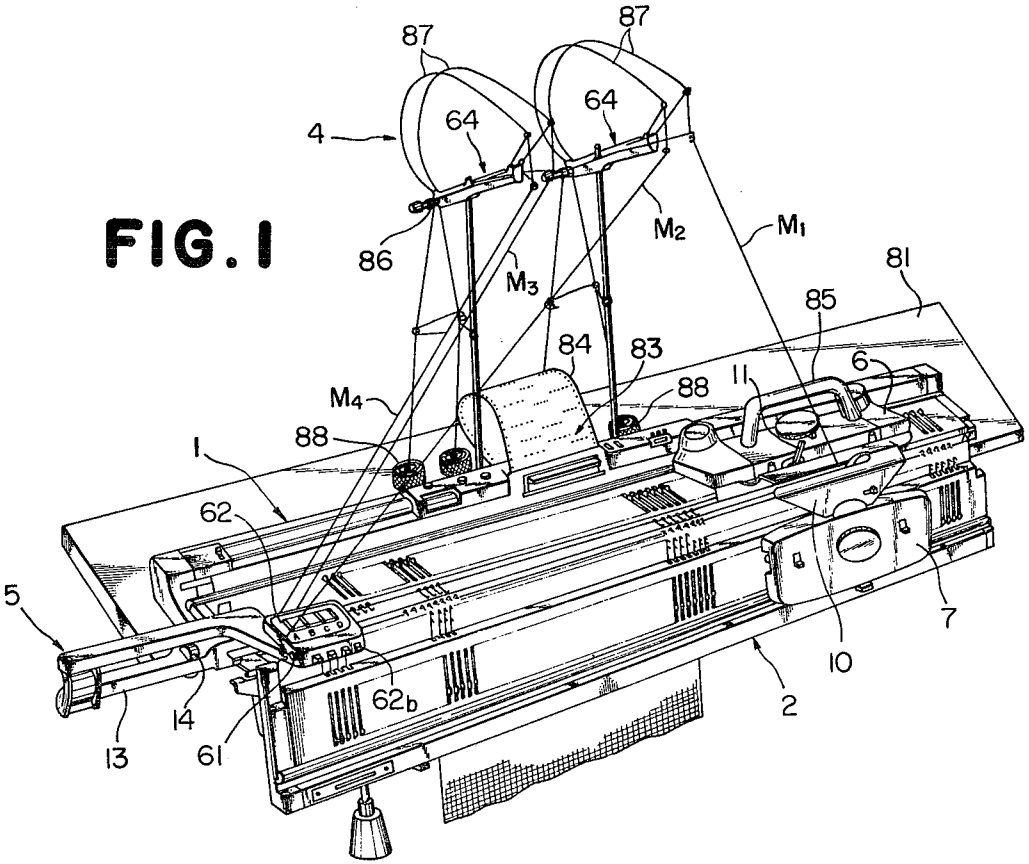
FIG. 1 is a perspective view of a hand-operated flat-bed knitting machine employing a yarn changing device according to the present invention.
Figure 2:
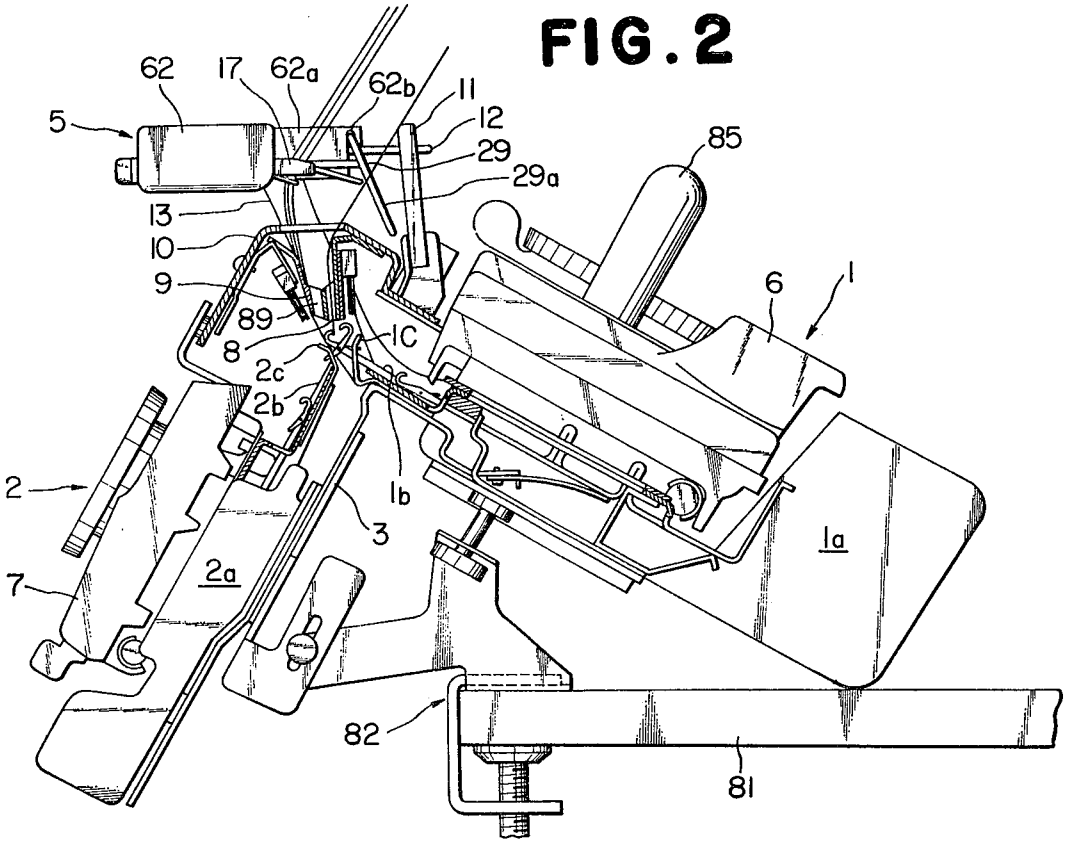
FIG. 2 is a side elevation of the machine shown in FIG. 1, partly in section, substantially along the center line of a connecting arm, illustrating a yarn supplied to knitting needles through a yarn carrier.

FIGS. 1 and 2 illustrate a hand-operated, flat-bed knitting machine employing a yarn changing device according to the present invention. The knitting machine comprises a first machine unit 1 to which a second machine unit or ribbing attachment 2 is removably attached with a right and a left fastening device generally designated by 3, thereby to constitute a so-called V-bed knitting machine. The first machine unit 1, however, may be independently used as a single bed machine. The machine is removably fixed on a working table 81 by a conventional clamping device generally designated by 82.

The first machine unit 1 includes a needle bed 1a having conventional movable latch needles 1*b* and fixed sinker elements 1*c* appropriately disposed for an operative relationship therewith. A carriage 6 having a conventional cam machanism (not shown) is mounted for reciprocating sliding movement on the needle bed 1*a* for knitting actuation of the needles 1*b*. A known needle selection control device 83 including a perforated punch card 84 is provided on the machine unit 1 and a pair of needle selecting means (not shown) controllable by the control device 83 is provided on the carriage 6. This arrangement permits a pattern to be knitted in accordance with the patterning program provided on the card 84.

The second machine unit 2 also includes a needle bed 2*a* having similarly arranged needles 2*b* and sinker elements 2*c*. A carriage 7 also having a conventional cam mechanism (not shown) is mounted for sliding movement on the needle bed 2*a*. The carriages 6 and 7 are removably connected by a connecting arm 10 and for manual operation by the machine operator (not shown). A handle 85 is provided on the carriage 6 for the convenience of manual manipulation by the machine operator. In normal operation, the carriages 6 and 7 move together, and are hereinafter referred to as the "combined carriage".

A conventional take-up device generally designated by 4 is removably mounted at the rear side of the first machine unit 1. The take-up device 4 includes two separate assemblies 64 each having a pair of yarn brakes 86 and a pair of take-up springs 87 to enable four different yarns M1, M2, M3, and M4 to be used in knitting. The respective yarns M1 to M4 are thus supplied from a yarn supply 88 to knitting needles 1*b* and 2*b* through the take-up device 4 and a yarn carrier 9 provided on the connecting arm 10. The take-up device 4 is adapted to take up possible slack of the yarns M1 to M4 between the yarn brakes 86 and the knitting needles 1*b* and 2*b*.

Figure 10:
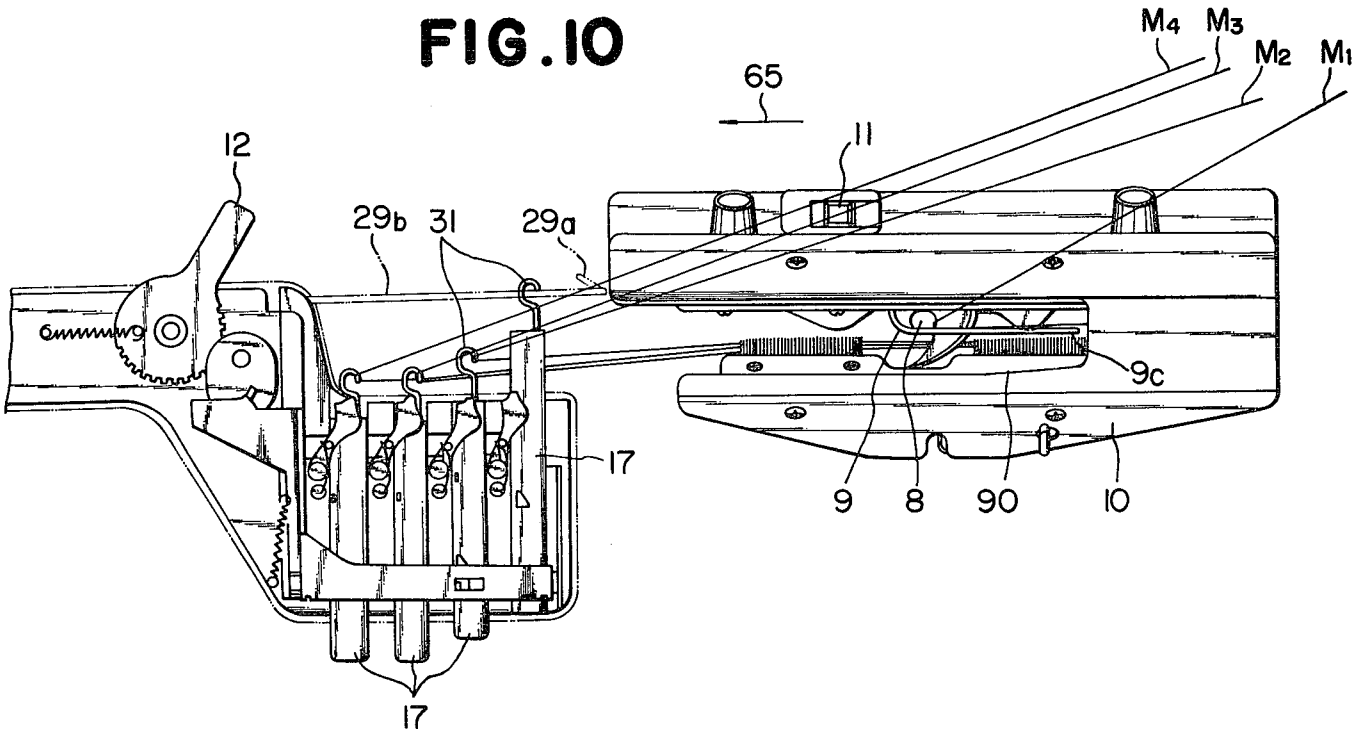
FIGS. 10 to 12 are plan views illustrating different steps in the yarn changing operation with the device.
Figure 13:
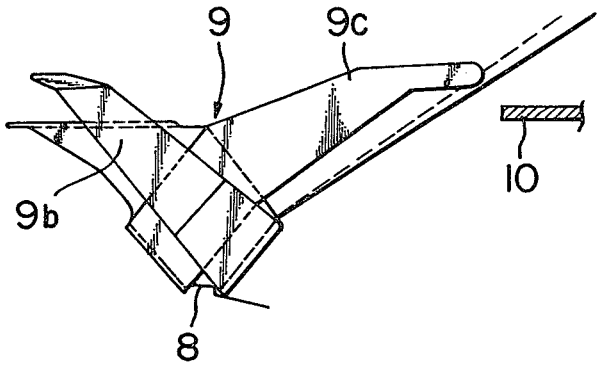
FIG. 13 is an enlarged front elevation of the yarn carrier with a yarn.

The yarn carrier 9 has the general shape of a flattened inverted triangle. Both end portions 9*b* and 9*c* of this triangle are folded together such as shown in FIGS. 10 and 13 to define an eye 8 to allow a yarn to be fed therethrough to the knitting needles 1*b* and 2*b*. A spacing 89 as shown in FIG. 2 exists between the folded portions and permits yarns M1 to M4 to be passed therethrough when changing the yarn to be fed through the eye 8 of the yarn carrier 9.

The yarn carrier 9 is fixed on the connecting arm 10 which includes a longitudinal cutout 90 which is open at the left end thereof. As shown in FIG. 10, the arm 10 has the general shape of a flattened mirrored C in its plan view. The yarn carrier 9 is disposed such that the eye 8 and the folded portions thereof are arranged substantially within the range of the cutout 90 of the arm 10, as viewed in its plan view as in FIG. 10, to thereby enable the yarns M1 to M4 to be guided into and out of the eye 8 through the cutout 90 of the arm.

The yarn changing device 5 embodying the present invention is provided at the left end portion of the machine. The yarn changing device 5 has a generally U-shaped construction, and includes four yarn guides 17 at the free end portion of one of the two arms of the U. The device 5 is removably fastened at the left end of the machine such that the yarn guides 17 are positioned substantially above the left end of the machine and the combined carriage comes inside the U without being disturbed by the yarn changing device 5 when it is moved to the left end of the machine.

As shown in FIGS. 1–5, the yarn changing device 5 further includes a support bracket 13 providing the other arm and the bridging portion of the U. The bracket 13 has a suitable fastening means at the end of the arm for removably fastening the yarn changing device 5 to the machine. The fastening means of this embodiment includes a clamping member 15 cooperative with the end 13a of the bracket 13 to clamp to a portion of the machine frame of the machine unit 1. The clamping member 15 is manually operated by means of a manually operable dial 14.

Figure 3:
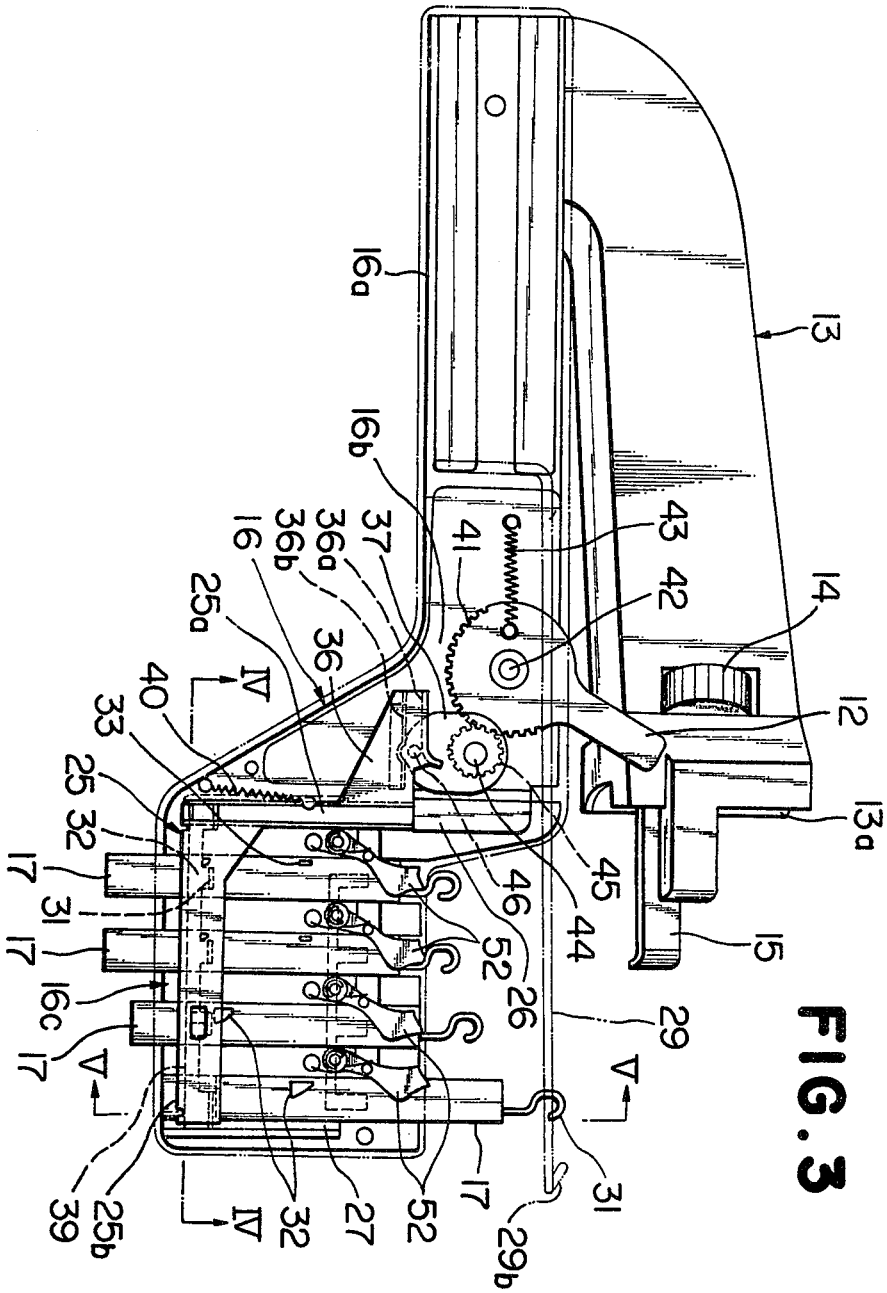
FIG. 3 is a plan view of a yarn changing device according to the present invention with a cover removed.

The yarn changing device 5 further includes a housing supported on the support bracket 13. The housing includes a base member 16 fastened to the bracket 13 and a cover 62 mounted on the base member 16. The base member 16 has the general shape of a plate and includes a left side portion 16*a* of a laterally elongated rectangle, a central offset portion 16*b*, and a right side portion 16*c* having the shape of a rectangle, all as shown in FIG. 3. A plurality of grooves 21 open at both ends are formed in parallel with each other with spaces therebetween on the right side portion 16*c*. The respective grooves 21 slidably accommodate the respective yarn guides 17. Additionally, a guide groove 26 parallel with the grooves 21 is provided on the left side of the leftmost groove 21. Each end of the groove 26 is enclosed by an upstanding member formed on the periphery of the base member. An additional groove 27 is provided on the right side of the rightmost groove 21 and connects directly to, and is formed as part of the rightmost groove 21.

Figure 4:
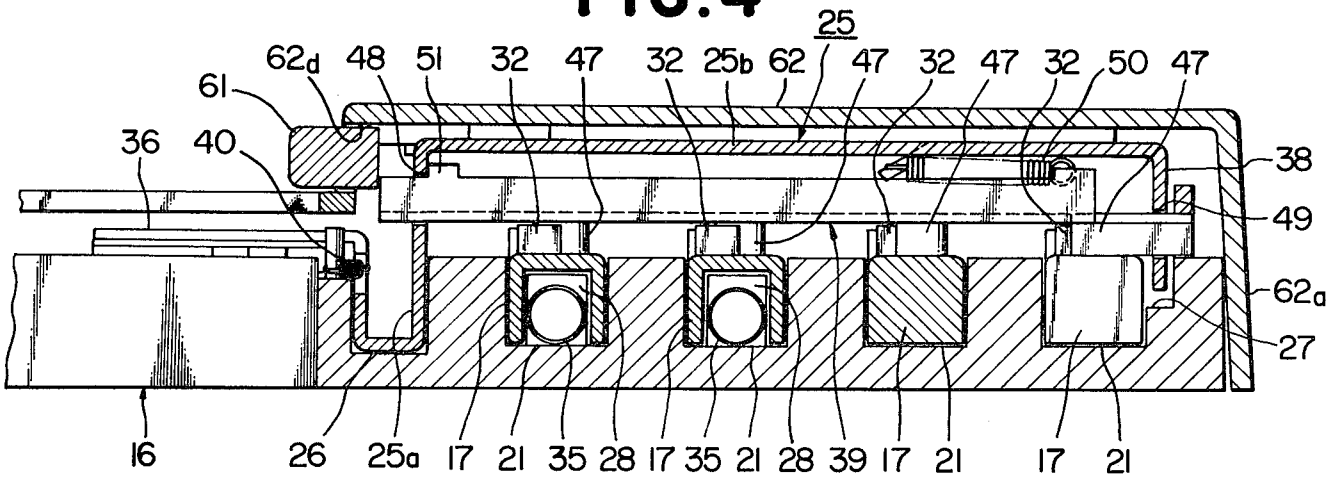
FIG. 4 is an enlarged section of the device taken substantially along line IV — IV of FIG. 3.
Figure 5:
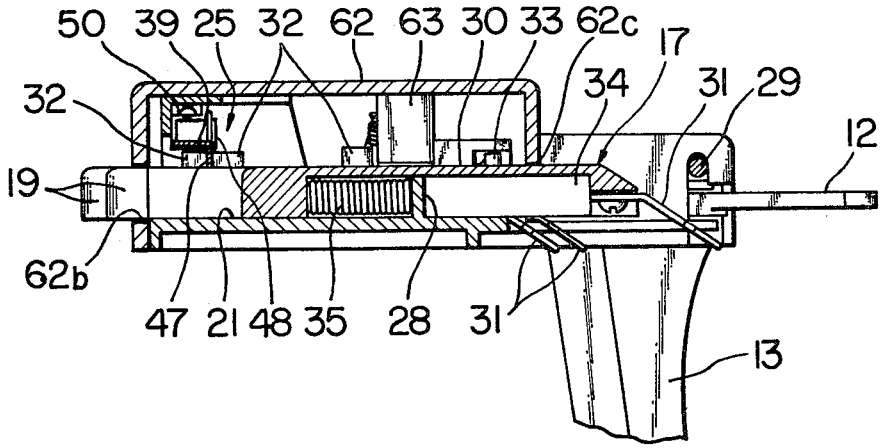
FIG. 5 is a section taken along line V — V of FIG. 3.

As shown in FIG. 4, each of the yarn guides 17 includes a key 30 having an inverted U section defining a hollow 34 which is closed at the front (left side in FIG. 5) and rear ends thereof. The key 30 is provided at the rear end with a hook 31 directed obliquely downwardly for engagement with a yarn. The hook 31 is fastened to the key 30 by a suitable means such as screw means. A nipple 33 is provided on the central portion of the upper surface of the key 20. Another projection 32 is provided on the front portion of the same surface. A lug 28 is disposed on a substantially central portion of each yarn guide 17 and extends into the hollow 34 of each key 30 from the bottom of each groove 21. Each such lug 28 is adapted to limit the slidable movement of the respective yarn guide 17 within the respective groove 21 on the base member 16. A compression spring 35 is interposed in the hollow 34 of each key 30 between the inner face adjacent one end of the hollow 34 and the lug 28 to urge the key 30, and, accordingly, the yarn guide 17, to the frontmost position. As shown in FIG. 5, a lug 63 depends from the inner wall of the cover 62 to a position adjacent the upper surface of each key 30 to prevent undesired floating of the yarn guide during sliding movement thereof.

The yarn changing device 5 further includes actuating means responsive to movement of the combined carriage for selectively actuating the yarn guides 17 for movement to the rearmost position against the urging of the springs 35. The actuating means includes a lever 12 pivoted by a pivot 42 on the base member 16. The lever 12 is urged by a spring 43 to a position as shown in FIG. 3 in which it obliquely crosses the passage of an actuating element 11 mounted on the carriage 6 so that the lever 12 is engaged by the actuating element 11 and pivoted around the pivot 42 in the counterclockwise and clockwise direction, respectively, when the combined carriage is moved to and from the leftmost extreme end of the machine.

The lever 12 also includes a row of teeth 41 arranged in a circle around the pivot 42. Another toothed gear 45 having its teeth engaged with the teeth 41 of the lever 12 is also pivotally mounted on the base member 16 by a pivot 44 and has a crank member 37 integrally attached thereto.

A generally L-shaped slider or actuator 25 is mounted for operation by a crank member 34. The slider 25 includes a first arm 25*a* which is received in the guide groove 26 of the base member 16 for slidable movement therealong. The slider 25 further includes an extension 36 which extends leftwardly from a rear portion of the first arm 25*a* thereof. The extension 36 has a cam groove thereon which runs perpendicularly to the guide groove 26 on the base member 16 and is defined by a pair of walls arranged in parallel and including a bent edge portion 36*a* of and a wall 36*b* mounted on the extension 36. A crank pin 46 mounted on the crank member 37 is slidably fitted in the cam groove of the extension 36 for clockwise pivotal movement of the crank member 37 around the pivot 44 to cause the slider 25 to be moved rearwardly with the first arm 25*a* thereof being guided along and by the guide groove 26 of the base member 16. Counterclockwise pivotal motion of the crank member 37, however, causes no movement of the slider 25 because the crank pin 46 is brought out of the cam groove defined by the walls 36*a* and 36*b* on the extension 36 of the slider 25.

In operation, movement of the combined carriage to the left extreme end of its stroke causes the lever 12 to be driven by the actuating element 11 and to be pivoted counterclockwise around the pivot 42. This pivotal movement of the lever 12 causes the crank member 37 to pivot clockwise around the pivot 44 due to the engagement of teeth of the lever 12 and the gear 45. As a result the slider 25 is moved in the rearward direction. When the actuating element 11 subsequently moves clear of the lever 12, the spring 43 restores the lever 12 and the crank member 44 to their original positions. At the same time another spring 40 provided between the slider 25 and the base member 16 restores the slider 25 to its original position as shown in FIG. 3. When the carriage is moved in the rightward direction from the left extreme end of its stroke, the lever 12 is also engaged and pivoted clockwise by the actuating element 11. In this case, however, the pivotal movement is through a smaller angle and effects a counterclockise pivotal motion of the crank member 37 which, as previously described, does not cause any rearward movement of the slider 25.

The slider 25 further includes a second arm 25*b* disposed perpendicularly to the first arm 25*a* and extending over and transverse to the aforementioned yarn guides 17 as shown in FIGS. 3 to 5. The second arm 25*b* of the slider 25 includes a leg 38 depending from the right extreme end thereof, with the lowermost end slidably fitted in the guide groove 27. Underlying the second arm 25*b* is an actuator member 39 which has both ends thereof slidably inserted in holdes 48 and 49 shown in FIG. 4 formed in the first arm 25*a* and the leg 38, respectively. The actuator member 39 is supported for translatable movement transversely to the yarn guides 17 and is normally urged by a tension spring 50 to bring an abutment 51 shown in FIG. 4 into contact with the first arm 25*a*.

The actuator member 39 is further provided along the lower edge thereof with teeth 47 extending downwardly for engagement with the front projections 32 on the yarn guides 17. When the actuator member 39 is in its "home" or starting position, its teeth 47 are disposed in the rear of and in alignment with the front projections 32 on the yarn guides 17 which are then positioned in their original or most advanced positions, hereinafter referred to as the "first inoperative positions." When the teeth 47 in the rear of the actuator member 39 engage with the front projections 32 to hold the yarn guides 17 against the urging of the respective springs 35 in the fully retracted positions, the yarn guides 17 are then in the positions hereinafter referred to as "second inoperative positions." It should be observed that when the slider 25 is moved in the rearward direction, the yarn guides 17 in the second inoperative position are actuated and moved rearwardly by the actuator member 39 on the slider 25.

In FIG. 3 the first and second yarn guides 17 from the left are shown in the first inoperative positions in which the forward ends of the keys 30 thereof are projected forwardly through window openings 62*b* formed in the cover 62. Accordingly, either or both of those yarn guides 17 in the first inoperative positions can be manually manipulated for movement in the rearward direction to the second inoperative positions as represented by the position of the third yarn guide 17 from the left in FIG. 3.

In order to allow each yarn guide 17 to be moved from the first to the second inoperative position without being disturbed by the teeth 47 of the actuator member 39, each yarn guide 17 has on its front projection 32 a camming surface 32*a* disposed to engage with a tooth 47 of and to translatingly displace the actuator member 39 in the rightward direction. Thus, manual manipulation of a yarn guide 17 from the first to the second inoperative position causes the actuator member 39 to be translatingly displaced against the urging of the spring 50 to bring its teeth 47 out of alignment with any projection 32. In the event another yarn guide 17 is then being held in the second inoperative position by the actuator member 39, such translation of the actuator member 39 will cause that yarn guide 17 to be released from the actuator member 39 so that the yarn guide 17 is permitted to be restored to the first inoperative position by the urge of the associated spring 35. Thus, movement of one yarn guide 17 from the first to the second inoperative position may result restoration of another yarn guide 17 from the second to the first inoperative position.

Upon a rearward movement of the slider 25 of the actuating means, the yarn guides 17 are moved or retracted to the rearmost position. In order to perform a yarn changing operation, as will be hereinafter described in detail, the yarn guide 17 is required to remain in such a rearmost position even after the slider 25 is restored to its "home" position. Thus, the yarn changing device 5 further includes locking means for releaseably locking the yarn guides 17 in an advanced position, hereinafter referred to as the "operative position."

The locking means includes a locking member 53 provided for each of the yarn guides 17. As shown in FIGS. 6 to 9, each locking member 53 is provided with a groove 55 on the reverse side of the rear end portion thereof. Each groove 55 is defined by two walls 55*a* and 55*b* disposed perpendicularly to each other and a projection 55*c* and is opened toward the right and rear side edges of the locking member 53. An upwardly oblique surface 56 is formed on the left of and adjacent to each groove 55 on the same side. The locking member 53 has an abutment 57 also provided centrally on the reverse side thereof. The locking member 53 is supported at the front end thereof horizontally and vertically, pivotally by a pivot 58 on the base member 16. A spring 39 wound around the pivot 58 urges the locking member 53 to a position in which the abutment 57 is contacted by the key 30 of the guide 19 and the rear portion thereof is contacted by the upper surface of the key 30. In other words the spring 39 urges the locking member 53 to its original or "home" position as indicated by the full line in FIG. 6. Adjacent to the pivots 58 the base member 16 is provided with slots 22 each for receiving therein an abutment 57 of the locking member 53 to permit a pivotal motion of the locking member 53 around the pivot 58.

Figure 6:
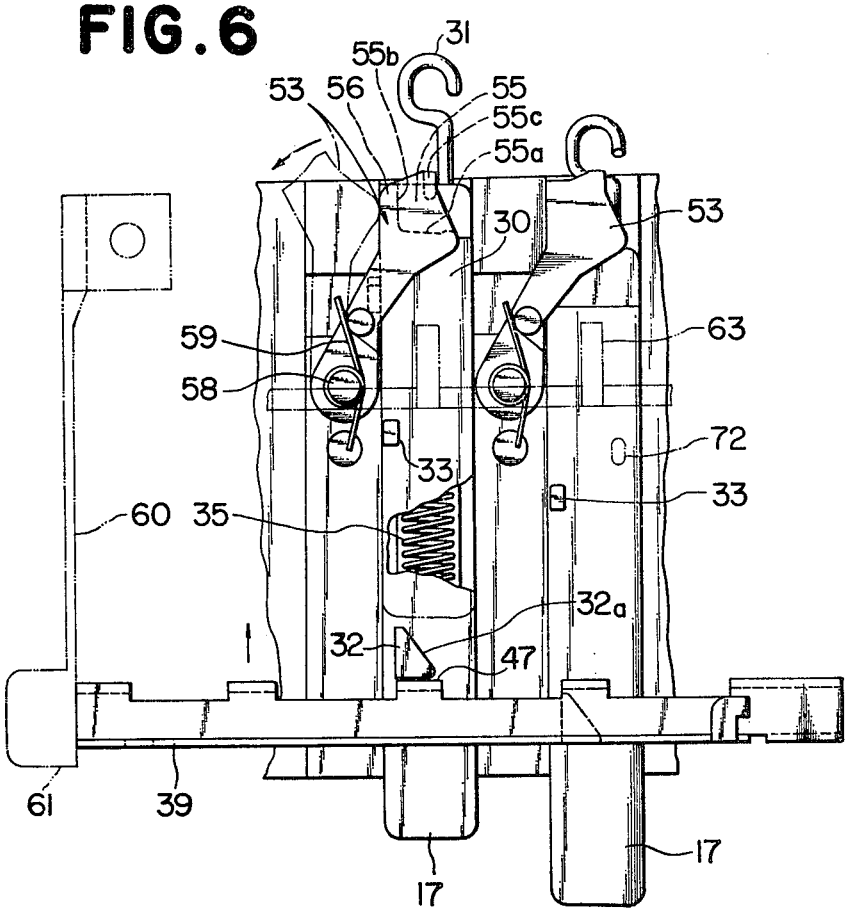
FIG. 6 is an enlarged plan view, partly fragmentary, showing details of the device.
Figure 7:
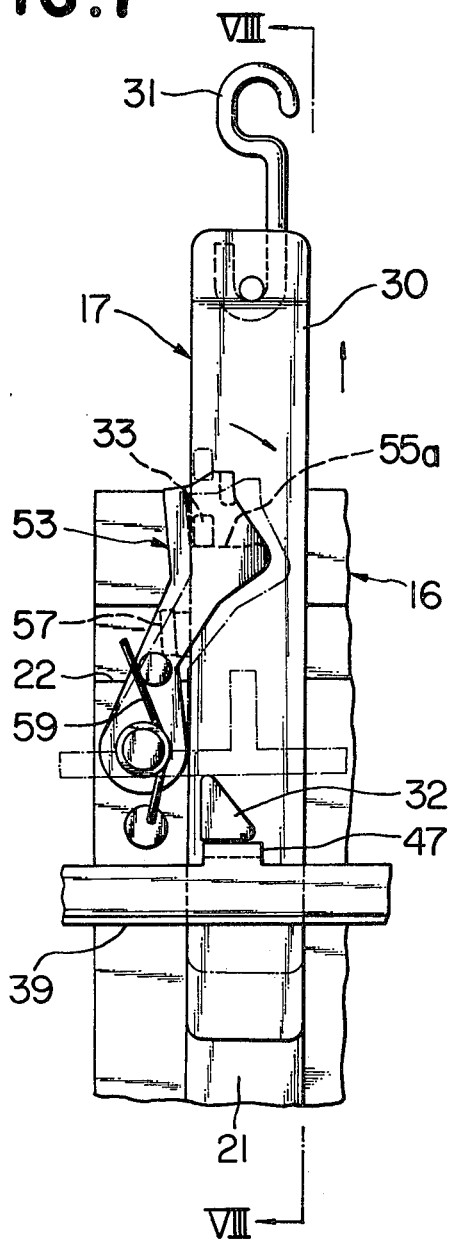
FIG. 7 is an enlarged plan view showing a yarn guide.
Figure 8:
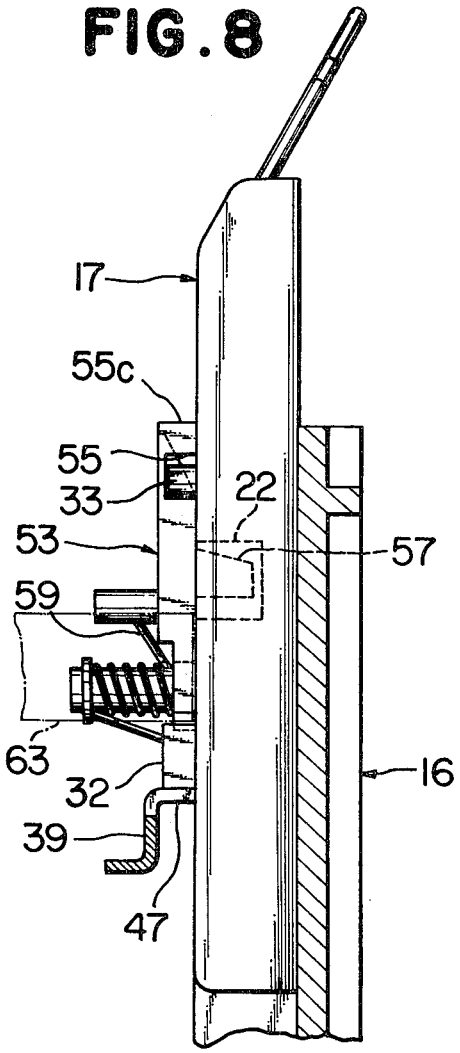
FIG. 8 is a section taken along line VIII — VIII of FIG. 7.
Figure 9:
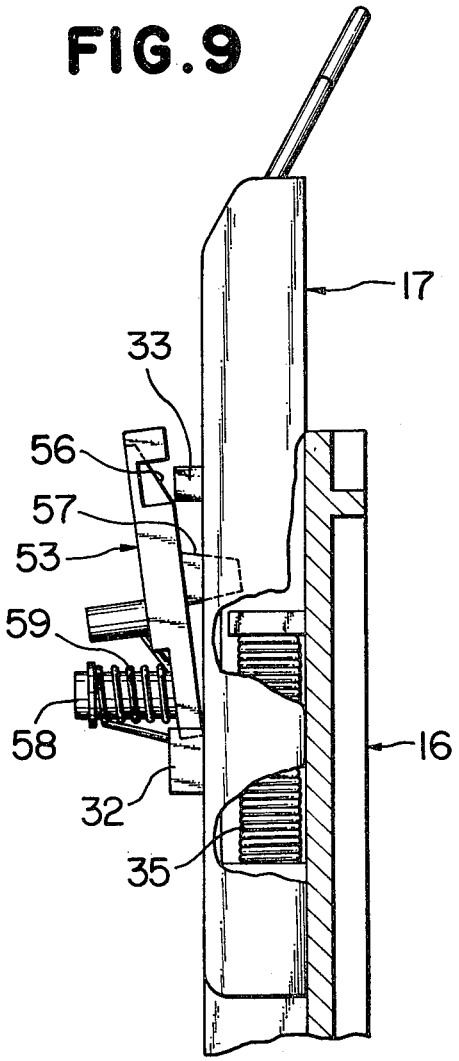
FIG. 9 is a sectional view, partly fragmentary, similar to FIG. 8.

In operation, as the yarn guide 17 is retracted, the nipple 33 on the yarn guide 17 first engages with the right side edge of the locking member 53 to cause the latter to pivot counterclockwise against the urging of the spring 59 as shown by the alternate long and short dashed line in FIG. 6. Then, as the yarn guide 17 is moved beyond the operative position to the rearmost position, the nipple 33 meets with the right side entrance of the groove 55 and is disengaged from the right side edge of the locking member 53 so that the locking member 53 is pivoted clockwise by the urging of the spring 59 to bring the projection 55*c* thereof into engagement with the nipple 33 of the key 30. Upon restoration of the slider 25 to its original position, the yarn guide 17 is advanced by the spring 35 to a position in which the nipple 33 is abutted by the wall 55*a*. During this movement, the nipple 33 is released from the projection 55*c* of the locking member 53 so that the locking member 53 is further pivoted clockwise to a position in which the nipple 33 is abutted by another wall 55*b*. In this manner, the locking member 53 is moved to a locking position in which both of the walls 55*a* and 55*b* are engaged by the nipple 33 of the yarn guide 17 as seen from FIGS. 7 and 8. At the same time the yarn guide 17 is locked or held by the locking member 53 against the urge of the spring 35.

Subsequently, when the slider 25 is moved again, the tooth 47 pushes the front projection 32 to move the yarn guide 17 locked in the operative position toward the rearmost position. At this time, the nipple 33 disengages from the wall 55 and the spring 59 further pivots the locking member 53 clockwise from the locking position so that the oblique surface 56 is brought into alignment with the nipple 33 as shown by dotted lines in FIG. 7. Then, when the slider 25 returns to the original position, the compression spring 35 drives the guide 17 to move to its original position. At this time the projection 33 comes in contact with the oblique surface 56 to push the blocking member 53 upwardly and to thereby pivot the locking member 53 upwardly with respect to the pivot 58 to permit the yarn guide 19 to return to its original position. See FIG. 9. In the event a second yarn guide 17 is positioned in the second inoperative position at the commencement of the second movement of the slider 25, the second yarn guide 17 will be similarly caused to be locked in the operative position after the return of the slider to its original position. In this manner a yarn guide 17 related to a desired yarn to be fed in a subsequent course of knitting may be selectively, manually moved from the first to the second inoperative position, and to then be brought into the operative position in response to a subsequent carriage movement towards the left extreme end of the machine. Moreover, with this arrangement, the fact that there is or maybe an unselected third yarn guide associated with another, unselected yarn will not prevent the first and second yarns from alternately being brought into the operative position. Additionally, it will be seen that it is possible with this arrangement to further select any one of the presently unselected yarn guides, regardless of the currently selected yarn guides.

Means are also provided for manually translating the actuator memer 39 in the rightward direction against the urging of the spring 50 to permit any yarn guide 17 to be released to return from the second to the first inoperative position. These means include a clearer bar 60 formed as a leaf spring, the rear end of which is attached to the cover 52. The clearer bar 60 has a button 61 at its front end and is disposed for alignment with and to be urged to engage with the left end of the actuator member 39. The button 61 is projected outwardly from the cover 62 through an opening **62*d* formed therein to permit manual manipulation and operation by the machine operator. In such a case in which more than two yarn guides 17 are moved to the second inoperative position, it is seen that the button 61 may be pushed rightwardly to permit those yarn guides 17** to be released therefrom.

As has been already described, each yarn guide 17 has three stable positions, namely the first and second inoperative positions and the operative position. The cover 62 of the housing has four openings **62*c* in the rear wall thereof through which the yarn guides 17 are projected rearwardly to permit the hooks 31 of the yarn guides 17 in any of the stable positions to be engaged with the respective yarns $M_1$ to $M_4$. The yarn guide 17 in the first or second inoperative position has its hook 31 positioned next to the cover 62. However, when the yarn guide 17 is in the operative position, its hook 31 is disposed under a guide rod 29 as shown in FIGS. 2, 3 and 5**.

The guide rod 29 is fixed at the left end portion thereof on the base member 16 and extends rightwardly in parallel with the moving direction of the carriage. On its right end the guide rod 29 has an extension **29*a* which is directed substantially in the vertical direction. The guide rod 29 is adapted to engage with a knitting yarn to force the yarn forwardly against the tension exerted by a take-up spring 87 of the take-up device 4 to bring the yarn into alignment with the hook 31 of the yarn guide 17 in the operative position and to thereby permit the yarn to be caught by and released from the hook 31 of the yarn guide 17** during a yarn changing operation as will be further described.

In the above described embodiment of the yarn changing device 5, a yarn guide 17 is constructed as having a hook 31 which is adapted to releaseably hold a knitting yarn. The yarn which is to be fed through the eye 8 of the yarn carrier 9 onto knitting needles is thus permitted to run from the take-up device 4 directly to the yarn carrier 9, as is represented by the yarn $M_1$ in FIGS. 1 and 10, so that the associated yarn guide 17, as the rightmost one in FIG. 10, is free from that yarn in use.

A general description will now be given of the yarn changing operation for the yarn changing device 5 having yarn guides 17 such as just described. When the carriage is moved leftwardly to pass over the device 5, all the yarns held by the device 5 are guided into the eye 8 through the spacing 89 of the yarn carrier 9. Subsequently, when the carriage C is moved rightwardly to pass over the device 5, only one of the yarns namely, the particular one to be used for knitting in the course of the rightward and subsequent leftward movement of the carriage, is released from the device 5 and left in the eye 8. The unselected yarns are guided out of the eye 8 through the spacing 89. Whether or not a given yarn is left in the eye 8 depends upon the positions of the various yarns in the course of the rightward movement of the carriage as it passes over the yarn changing device 5. For example, a yarn which is positioned at the front side of the tip end of the right end portion **9*c* of the yarn carrier 9 is guided out through the spacing 89. However, a yarn which is positioned at the rear side of the tip end of the right end portion 9*c*, is left in the eye 8. Thus, the right end portion 9*c*** is adapted to classify a yarn to be used or active from yarns to be unused or inactive in the succeeding knitting course.

Figure 11:
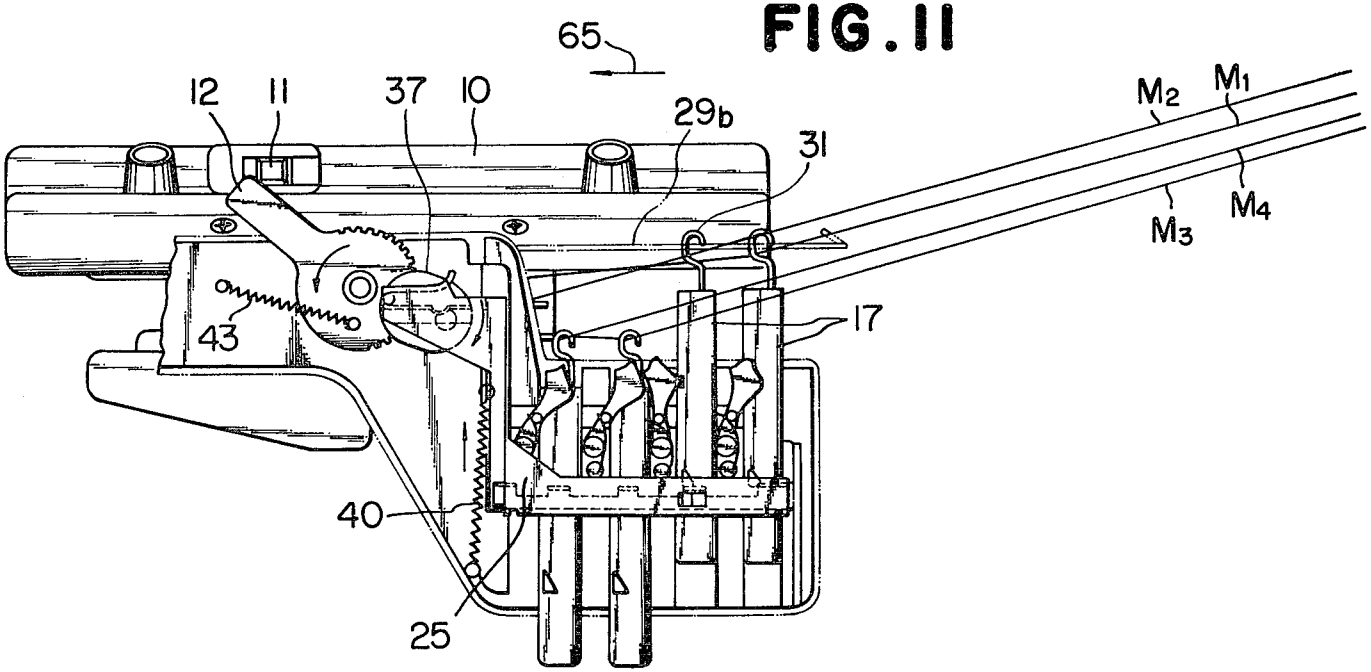
Figure 12:
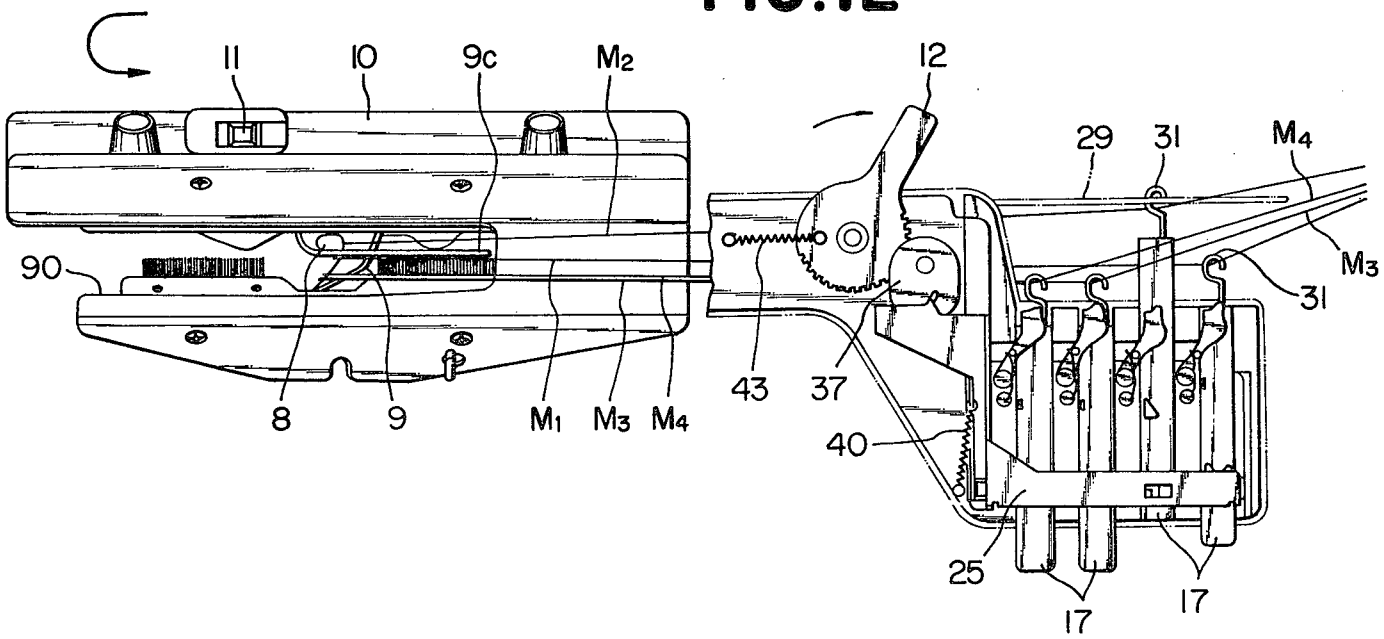

Different stages of the yarn changing operation will now be described with reference to FIGS. 10 to 12 in which the carriage is represented by the connecting arm 10 for clarity of the drawings. In FIG. 10, four yarns M1 to M4 corresponding to the first to fourth yarn guides 17 counted from the right are used. Assume now that the third and fourth yarn guides 17 are in the first inoperative position, that the second yarn guide 17 is in the second inoperative position, that the first yarn guide 17 is in the operative position, that the yarns M2 to M4 are caught by the associated yarn guides 17 and that the yarn M1 is released from the hook 31 of the associated yarn guide 17 to be fed through the eye 8 to the knitting needles. In such a situation, when the carriage (i.e. the connecting arm 10) is moved to the left (i.e. in the direction of the arrow 65), the yarn M1 is engaged by the extension **29*a* of the guide rod 29 (see also FIG. 2) to be advancingly guided to the horizontal portion 29*b* of the guide rod 29 against the tension provided by the associated take-up spring 87. Subsequently, the actuating element 11 on the carriage is engaged with the lever 12 on the yarn changing device 5 to pivot the lever 12 in the counterclockwise direction. As a result, the second yarn guide 17 is retracted up to the rearmost position to place the hook 31 associated therewith under the guide rod 29. At the same time, the first yarn guide 17 is also retracted up to the rearmost position. Then, the yarn M1 is guided by the guide rod 29 and is caught by the hook 31 of the first yarn guide 17 (FIG. 11). By this point in time, all of the remaining yarns M2 to M4 have been guided into the eye 8 through the spacing 89 of the yarn carrier 9. It is seen that after the actuating element 11 has been disengaged from the lever 12 as the carriage continues to move to the left, the first yarn guide 17 advances to the second inoperative position due to the urging of the spring 35 and the yarn M1 is caught by the hook 31 (FIG. 12**).

Then, when the carriage direction is reversed for sliding movement in the rightward direction, the engagement of the actuating element 11 with the lever 12 does not effect any shifting movement of yarn guides 17 as previously described so that all the yarn guides 17 remain in their respective positions. Thus, the yarn M2 which is associated with the yarn guide 17 now in the operative position is brought in the rear of the tip of the right end portion 9c of the yarn carrier 9, and is released from the hook 31 of the associated yarn guide 17 to remain in the eye 8 of the yarn carrier 9 in order to be fed onto knitting needles during further carriage operation. Meanwhile, the yarn M1 associated with the yarn guide 17 now in the second inoperative position as well as the other yarns M3 and M4 associated with the yarn guides in the first inoperative position are brought in front of the tip end of the right end portion 9c of the yarn carrier 9 to be guided out of the eye 8 thereof and to remain in the hooks 31 of the associated yarn guides 17.

Figure 14:
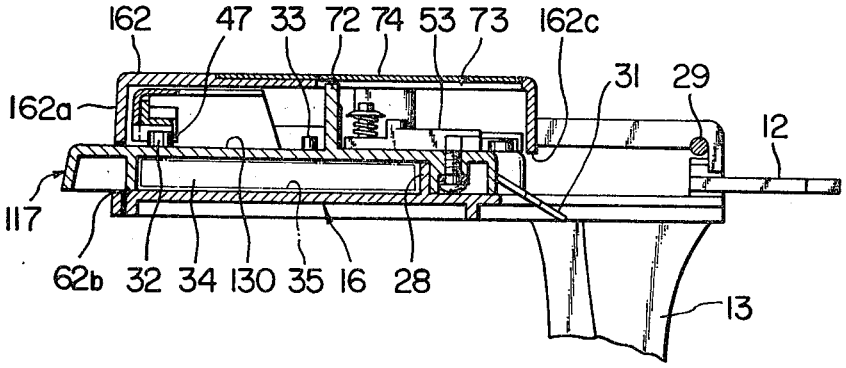
FIG. 14 is a section similar to FIG. 5 illustrating another embodiment of the device according to the present invention.

Reference will now be made to FIG. 14 which shows another embodiment of the yarn changing device having an indicating means to facilitate identification by the machine operator of the position of each yarn guide. Yarn guides 117 having slightly modified shapes from those previously discussed are each provided with an upstanding lug or pointer 72 near the rear projection 33 on the central upper surface thereof. See FIG. 6. It is seen that this arrangement allows each pointer 72 to extend upwardly to reach within a corresponding slot 73 formed in the cover 162 to provide a visual indication of the yarn guide positions to the machine operator. In a preferred embodiment, the top surface of each pointer 72 is color coded to facilitate identication. Additionally, for example, marks representing the three stable positions for each yarn guides 117, i.e. the first and second inoperative positions and the operative position, are put on the upper surface of the cover 162 near the respective slots 73 and a transparent upper plate 74 covering the slots 73 is fastened onto the upper surface of the cover 162. The marks may be printed or embossed on the upper plate 74.

Figure 15:
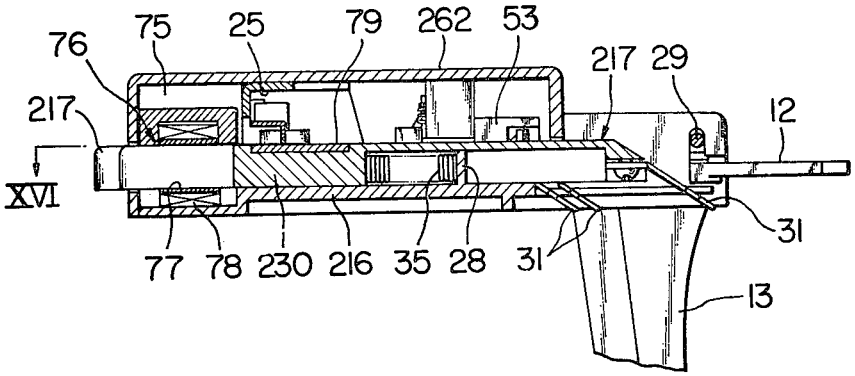
FIG. 15 is a sectional view similar to FIG. 14 illustrating a further embodiment.
Figure 16:
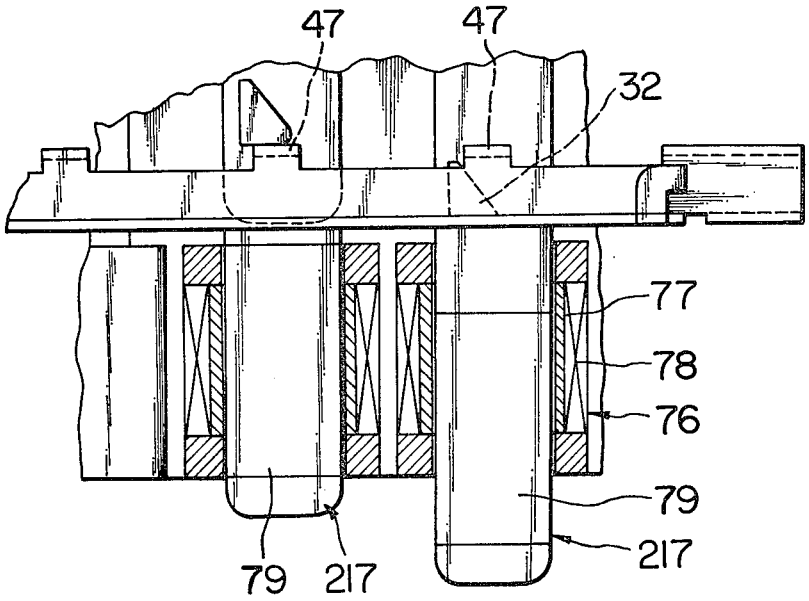
FIG. 16 is an enlarged partial section taken substantially along line XVI of FIG. 15.

FIGS. 15 and 16 illustrate a further embodiment of the yarn changing device which is designed for electric control by a control circuit means. In these figures, the housing includes a base member 216 and a cover 262 but is more elongated at a portion thereof forward of the slider 25 in the sliding direction of the yarn guides 17 as compared to the previous embodiments to provide a space 75. The space 75 accommodates electromagnets or solenoids 76 corresponding to the respective yarn guides 217. Each solenoid 76 is provided with a bobbin 77 with a square hole for receiving a front portion of the similarly elongated yarn guide 217 and a coil 78 wound around the bobbin 77. A plate member 79 made of ferromagnetic material having the same length as of the solenoid 76 is embedded in a frontal portion of each yarn guide 217. The plate member 79 projects forwardly from the solenoid 76 (see the right side plate member 79 in FIG. 16) when the yarn guide 217 is in the first inoperative position. When the yarn guide 217 is in the second inoperative position, it is in alignment with the solenoid 76 (see the left side plate member 279 in FIG. 16). When the solenoid 76 associated with a yarn guide 217 in the first inoperative position is energized, the plate member 79 on the yarn guide 217 is moved backwardly by the solenoid 76 so that the yarn guide 217 is moved to the second inoperative position where it is retained. Thus, a given yarn guide 217 may be selectively moved from the first to the second inoperative position by means of an electric current supplied to the associated solenoid.

In the embodiments thus described, all of the yarn guides are formed as having hooks for releasably catching the yarns. It will be understood, however, that they may be constructed each to have a round hole or eye unreleasably holding the yarn such as in the yarn changing device disclosed in Swiss Pat. No. 387,858.

What is claimed is:

1. In a yarn changing device for a flat-bed knitting machine having a carriage slidable on a needle bed of the machine, the yarn changing device having a housing supported at one end portion of the needle bed, three or more yarn guides mounted in the housing for movement from and to an operative position, and a spring for each yarn guide for urging the associated yarn guide from the operative position, and wherein each of the yarn guides has a first and a second inoperative position and is selectively operable to be moved from the first to the second inoperative position, the improvement comprising:

actuating means responsive to movement of the carriage to actuate a yarn guide in the second inoperative position to effect a movement thereof to and beyond the operative position;

a locking member provided for each of the yarn guides, each such locking member having a locking position in which it is adapted to lock the associated yarn guide in its operative position and having a rest position in which each such locking member is free of the associated yarn guide; and means for moving each of such locking member from its vest position to its locking position in response to movement of the associated yarn guide beyond the operative position and for thereafter moving each such locking member to its rest position in response to a subsequent movement of the associated yarn guide from its operative position.

2. The improvement as described in claim 1 wherein said actuating means includes an actuator member common to the yarn guides and normally positioned to be engaged by and to hold a yarn guide in its second inoperative position against the urging of the associated spring, the associated spring urging the yarn guide towards the first inoperative position, and further comprising releasing means responsive to movement of a yarn guide from its first to its second inoperative position for releasing another yarn guide from the actuator member to permit the other yarn guide to be restored to its first inoperative position.

3. The improvement as described in claim 2 wherein the releasing means is a cam means provided on each of the yarn guides for displacing said actuator member to bring said actuator member out of engagement with said other yarn guide.

4. The improvement as described in claim 2 further comprising an electromagnetic means provided for each of the yarn guides and energizable to actuate the associated yarn guide for movement from its first to its second inoperative position.

5. The improvement as described in claim 2 wherein the yarn guides are each provided with a portion extending outwardly from the housing so as to be manually operable to be moved from the first to the second inoperative position against the urging of the associated spring.

6. The improvement as described in claim 1 wherein the yarn guides are each provided with a projection and are disposed in parallel with one another to be movable between their respective first and second inoperative and operative positions; and said actuating means includes a first member mounted for movement in a direction parallel to the longitudinal axes of the yarn guides, a second member supported on the first member and adapted to be directed and moved in a direction transverse to the longitudinal axes of the yarn guides and having thereon teeth for engagement with said projections on the yarn guides, a spring for urging said second member in a predetermined direction, and a stop means for normally holding said second member against the urging of said spring in a position in which said projections on the yarn guides are aligned with the teeth of the second member; each of said projections on the yarn guides including a cam surface operative in response to movement of the respective yarn guide from the first to the second inoperative position to be engaged with a tooth of said second member to displace said second member against the urging of said spring to cause the teeth of said second member to be brought out of alignment with said projections on the yarn guides to thereby permit the yarn guides to be released from the second inoperative position.

7. The improvement as described in claim 6 wherein said actuator means further includes a pivot mounted in the housing; a lever pivotally mounted on said pivot, said lever extending outwardly from the housing for engagement with the carriage and adapted to be driven thereby for pivotal movement about the pivot; a rotary to linear motion converter for imparting the pivotal movement of said lever to said first member to move said first member in a direction parallel to the longitudinal axes of the yarn guides, said motion converter including a crank member operatively connected with said first member; and means for restoring said lever, said motion converter, and said first and second members to their respective rest positions after said lever is disengaged from the carriage.

8. The improvement as described in claim 1 wherein the yarn guides are each provided with a projection and are disposed in parallel with one another in a plane for movement in the plane; and each of said locking members is mounted for rockable movement in a first direction parallel with said plane and also in a second direction perpendicular to said plane and has a cam means for engagement with said projection of the associated yarn guide to bring said locking member to the locking position when the associated yarn guide is first moved beyond the operative position and then to the rest position when the associated yarn guide is again moved from the operative position; each of said locking members being operatively associated with a spring means for urging said locking member towards the associated yarn guide to permit said cam means to be engaged with said projection of the associated yarn guide.

9. The improvement as described in claim 8 wherein said cam means on each of said locking members provides a first rockable movement of said locking member in said first direction when the associated yarn guide is first moved beyond the operative position and a second rockable movement in said second direction when the associated yarn guide is then moved from the operative position.

10. The improvement as described in claim 1 further including means for indicating the positions of the respective yarn guides.

11. In a yarn changing device for a flat-bed knitting machine having a carriage slidable on a needle bed of the machine, the yarn changing device having a housing supported at one end portion of the needle bed, three or more yarn guides mounted in the housing for movement from and to an operative position, and a spring for each yarn guide for urging the associated yarn guide from the operative position, the improvement comprising:

means operable for selecting and holding a predetermined yarn guide;

arresting means for releaseably arresting a yarn guide in the operative position; and means for moving a selected yarn guide to the operative position and for releasing an arrested yarn guide from the operative position.

12. In a yarn changing device for a flat-bed knitting machine having a carriage slidable on a needle bed of the machine having knitting needles adapted to knit with a plurality of yarns, the improvement comprising:

a support bracket removably mounted at one end of the needle bed;

A housing supported on the support bracket and including a base member and a cover, said base member having three or more parallelly arranged grooves formed thereon;

a yarn guide received in each of said grooves on said base member for longitudinal slidable movement and having an operative position to permit the associated yarn to be fed onto the knitting needles and an inoperative position;

a spring for each of said yarn guides to urge said yarn guide from the operative position to the inoperative position;

a member common to each of the yarn guides for normally retaining a given yarn guide against the urging of said spring in an intermediate position between the operative position and the inoperative position;

means operable to actuate the common member to move a yarn guide from the intermediate position to beyond the operative position;

said cover having slots formed therein for permitting the yarn guides to extend therethrough outwardly from said housing at either end of each yarn guide thereby to enable manual movement of the yarn guides from the inoperative position to the intermediate position;

releasing means operable in response to movement of a yarn guide from the inoperative position to the intermediate position for releasing another yarn guide from said common member; and arresting means for releasably arresting a yarn guide in the operative position so that a yarn guide which has been moved beyond the operative position may be subsequently arrested by said arresting means in the operative position and thereafter released therefrom when said yarn guide is subsequently moved from the operative position.

13. In a yarn changing device for a flat-bed knitting machine having a carriage slidable on a needle bed of the machine and also having a take-up device mounted at a rear portion of the needle bed and having three or more take-up springs, the improvement comprising:

a support removably mounted at one end of the needle bed;

a housing supported on said support;

three or more yarn guides mounted in said housing in parallel with one another and extending rearwardly outside said housing;

a hook attached at the rear end of each yarn guide for releaseably holding a yarn;

a spring for each yarn guide for urging the yarn guide from a rearmost operative position to frontmost inoperative position;

means operable to successively select and hold two yarn guides; and means for alternately moving the two selected yarn guides to the operative position in response to reciprocation of the carriage on the needle bed, said moving means including an arresting member for each yarn guide for releaseably arresting the yarn guide in the operative position against the urging of said associated spring, and an actuator member operable to move one of the selected yarn guides to the operative position and to release the other yarn guide from said associated arresting member to be restored from the operative position by the urging of said associated spring.

14. The improvement as described in claim 13 further comprising a guide rod for engagement with a yarn to force the yarn forwardly against the tension exerted by a take-up spring to bring the yarn into alignment with said hook of the yarn guide positioned in the operative position to thereby permit the yarn to be caught and released from said hook of the yarn guide.

* * * * *